United States Patent [19]

Perun et al.

[11] 4,192,497

[45] Mar. 11, 1980

[54] COMPOSITION FOR THE SURFACE OF SHEET SEPARATING DEVICES

[75] Inventors: William D. Perun; Paul C. Amatangelo, both of Webster, N.Y.

[73] Assignee: Xerox Corporation, Stamford, Conn.

[21] Appl. No.: 772,388

[22] Filed: Feb. 28, 1977

Related U.S. Application Data

[63] Continuation of Ser. No. 464,393, Apr. 26, 1974, abandoned.

[51] Int. Cl.[2] ..... B65H 3/52

[52] U.S. Cl. ..... 271/18; 271/121

[58] Field of Search ..... 271/124, 125, 121, 122, 271/123, 34, 35, 167, 18 R, 137, 138

[56] References Cited

U.S. PATENT DOCUMENTS

| | | | |
|---|---|---|---|
| 3,469,834 | 9/1969 | Stange et al. | 271/10 |
| 3,768,803 | 10/1973 | Stange | 271/34 |

*Primary Examiner*—Bruce H. Stoner, Jr.

*Attorney, Agent, or Firm*—Ernest F. Chapman

[57] ABSTRACT

A composition is described for use on the surface of separating members or devices used in separating superposed sheets. Good sheet separation is obtained without delamination of the sheets when microcellular elastomeric materials having a hardness of at least 25 durometer are used as the surface material of the sheet separating devices. The sheet separating devices having the described surface material, have utility as retarding rolls and abutment members in sheet feeders, such as in xerographic apparatus.

20 Claims, 2 Drawing Figures

COMPOSITION FOR THE SURFACE OF SHEET SEPARATING DEVICES

This is a continuation of application Ser. No. 464,393, filed Apr. 26, 1974, now abandoned.

BACKGROUND OF THE INVENTION

This invention relates generally to sheet feeding and separating apparatus, and more particularly, to compositions for the surfaces of sheet feeding and separating apparatus to improve serially feeding superposed sheets from a stack of sheets to a xerographic machine. The invention further relates to compositions for the surfaces of sheet retarding devices in paper handling systems.

The development of high speed xerographic machines has brought about the need for simple yet reliable document feeder and separator apparatus capable of handling documents (sheets) varying in length, width, thickness, weight, and surface conditions. In order to serve in a wide variety of applications these same machines require that the feeder and separator apparatus operate efficiently and reliably both as an automatic feed on the one hand and as a manual input feeder on the other hand.

For example, in the automatic sheet feeder and separator apparatus of the type disclosed in U.S. Pat. No. 3,469,834 issued to Stange, Lux and Michaels and U.S. Pat. No. 3,768,803 issued to Stange, there are described means for advancing and separating superposed sheets having varied physical characteristics comprising various types of retarding members having frictional resistivity surfaces thereon to cause good sheet separation of the superposed sheets stacked in a holder for feeding into a xerographic machine. The separation belt and retard member are employed in these patents for queuing and advancing the sheets and/or separating them from the stack. In these patents, the region of contact between the retarding member and the separation belt form a sheet queuing throat which is able to "fan out" or queue sheets passed through it. In U.S. Pat. No. 3,768,803 the separation belt and retard member are positioned adjacent the edge of a stack of sheets, and the sheets translate a very short distance before reaching a sheet queuing throat because the retard member is positioned close to the edge of the stack.

In the above-cited references and in retard or retarding members in general, the retard member may assume various shapes, sizes, thicknesses, and configurations, including rolls, belts, endless belts, shoes, pads, and the like. In U.S. Pat. No. 3,469,834 the retarding roll or abutment member has a frictional member thereon which is formed of a resilient material having a lower coefficient of friction than that of the separator feed belt, said resilient material being mounted on a retarding roll or abutment member in alignment and engagable with the separator feed belt. In U.S. Pat. No. 3,768,803 the retard surface is preferably a soft rubber of about 40 durometer rating. This resiliency or softness permits the lead edge of the sheets to "dig into" the retard means. The retard means should not be too soft, however, or wear will be excessive. For this reason, it is suggested that the retard means be grooved to give it mechanical softness, resiliency or flexibility while the durometer of the material is high to minimize wear. Thus, the shortcomings of the retard surfaces of the prior art retard members are a high wear rate when the retard surface is of a soft, rubber material. When the hardness or durometer rating of the retard surface is high to minimize the wear of the surface, the resulting effect on the paper is lead edge delamination. Accordingly, a decrease in retard wear rate implies an increase in lead edge delamination of the sheets. Furthermore, decrease in hardness of the retard surface also results in sheet multifeeds.

OBJECTS OF THE INVENTION

Accordingly, it is a primary object of this invention to provide a retard surface wherein a decrease in retard wear rate does not necessarily cause an increase in lead edge delamination.

Another object of this invention is to provide an apparatus for separating superposed sheets and feeding them into a xerographic machine wherein sheet multifeeds are eliminated.

It is another object of this invention to provide a retard surface which is soft to permit the lead edge of the sheets to "dig into" the retard means without causing excessive wear of the retard surface.

Another object of this invention is to provide a method of separating superposed sheets and feeding said sheets into a xerographic machine by providing a retard surface which reduces or eliminates lead edge delamination of said sheets.

SUMMARY OF THE INVENTION

These and other objects of the invention are attained by providing a retard member, the surface of which comprises a microcellular elastomer having a hardness of at least about 25 durometer. It was originally thought that an elastomeric material of less than about 40 durometer rating would result in excessive wear of the retard surface even though it would eliminate lead edge delamination. However, the use of an elastomer having a durometer rating of at least about 25, unexpectedly resulted in a very low retard wear rate when the elastomer comprised a microcellular structure. The microcellular elastomer having a hardness of at least about 25 durometer rating performs far superior to solid elastomer materials having a hardness of about 40 durometer rating. Thus, the microcellular structure of the elastomer is critical in providing a surface for retard members in accordance with the present invention. As used herein, durometer is defined as Shore A or Shore A durometer.

Retard members, including retard rollers, belts, endless belts, shoes, pads and the like having microcellular elastomeric surfaces with a hardness of at least about 25 durometer rating wear extremely well, separate ream interface slugs exceptionally well and exhibit a substantially lower amount of lead edge delamination than any of the solid (non-microcellular) elastomers of the prior art having similar hardness durometer ratings.

Other objects of the invention will become readily apparent to those skilled in the art in view of the following detailed description thereof, especially when read in conjunction with the accompanying drawing.

DESCRIPTION OF THE PREFERRED EMBODIMENTS

Figure 1:
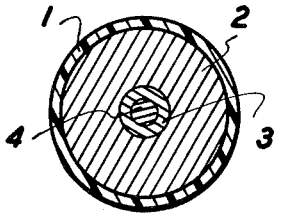
FIG. 1 is a sectional view of a retard roll having a microcellular elestomeric surface.

In a preferred embodiment in accordance with the present invention, a retarding member having a resilient surface for separating superposed sheets without delamination of the sheets and for feeding said sheets into a xerographic machine, comprises a microcellular polyurethane subjected to a foaming process to reduce the hardness thereof to above at least about 25 durometer rating, the microcellular polyurethane foam produced thereby having a density of about 36 pounds per cubic foot to about 52 pounds per cubic foot, a tensile strength of at least about 180 pounds per square inch, a tear strength of at least about 8 pounds per inch, an ultimate elongation of at least about 230 percent and 25 percent compression deflection at about 35–65 pounds.

It is also preferred in accordance with the present invention that the microcellular elastomer including the microcellular polyurethane described above, have a microcellular cell size of about 0.005 inch. This is an average cell size, and as used herein the cell size may vary as long as the effective durometer of at least about 25 durometer is maintained. Thus, cell size is important in the practice of the present invention, and variations therein which result in an effective durometer hardness rating of at least about 25, are within the scope of the invention. This microcellular cell size is provided by the method of forming the cells within the elastomer, and one skilled in the art can adjust the cell size of the elastomer so that it is within the range of cell sizes operable in accordance with the present invention. Furthermore, it is not objectionable that the microcellular elastomer of the present invention have voids or craters or other similar irregularities spaced therethrough. These irregularities or voids result randomly in the microcellular elastomer during compounding of such microcellular elastomeric materials. Although there is no intention to be held by the theory of operation of the microcellular elastomers in accordance with the present invention, it is believed that the microcellular formations within the elastomers, for example, the microcellular polyurethane, prevents heat buildup during operation, and accordingly, provides the improved surface for separating and feeding sheets from a stack. In the prior art solid (non-microcellular) elastomers used as resilient surfaces with a hardness of about 40 durometer rating or higher, it is believed that there is an undesirable heat buildup which causes malfunction of the sheet feeding devices.

Preferred modes upon which the microcellular polyurethane surfaces of the present invention are operable for retard members, in accordance with the present invention, are disclosed in U.S. Pat. No. 3,469,834 issued to Stange, Lux, and Michaels on Sept. 30, 1969 for Sheet Feeder and Separator Apparatus, incorporated herein by reference. Particularly therein, in FIGS. 3 and 8 are shown a friction member 281 formed of a resilient material having a lower coefficient of friction than that of a separator feed belt 260. The friction member 281 is mounted on retarding roll or abutment member 282 in alignment and engagable with separator feed belt 260. The microcellular elastomer having a hardness of at least about 25 durometer rating of the present invention may be used as resilient surface 281 as described in Column 7, lines 25–31, and Column 15, lines 41–57 wherein is claimed a means for advancing and separating superposed sheets having varied physical characteristics comprising, a retarding member having a curved frictional resistive surface thereon, means supporting the retarding member, a pair of pulleys journaled for rotation opposite the retarding member on either side thereof in the direction of feed, a flexible endless belt member entrained about the pulleys and forming an arcuate wrap over the surface of the retarding member to define a throat, means for supporting a stack of sheets adjacent the throat, nudging means for advancing the uppermost sheet in the stack into the throat, and drive means for driving the belt member and the nudging means in a direction to advance the uppermost sheet from the stack and through the throat.

Another example of a retard surface which may be used in accordance with the present invention, is disclosed in U.S. Pat. No. 3,768,803 issued to Stange on Oct. 30, 1973, claiming therein a sheet feeding and separating apparatus for feeding and separating individual sheets from a stack of sheets at an edge of the stack wherein the improvement comprises, an endless sheet feeding and separating belt mounted for sheet feeding engagement with the edge of the stack of sheets; the feed belt being rotatably mounted between spaced supports; a retard member having a supported finitely curved frictional retard surface, said retard surface deformably engaging said feed belt in the unsupported section of the feed belt to form therewith a correspondingly curved sheet queuing throat in which said retard surface in said belt are continuously mechanically biased against one another; said sheet queuing throat being positioned directly adjacent the edge of the stack and said feed belt operatively extending over only the edge of the stack, cooperatively preventing buckling of sheets fed from the stack by said feed belt into said sheet queuing throat. In U.S. Pat. No. 3,768,803 incorporated herein by reference, a retard pad having a surface 11 is shown in FIGS. 1, 3, 4, 5A, 5B, 6–16 and is amply described throughout the specification thereof.

The novel use of the compositions in accordance with the present invention is described with reference to FIGS. 1 and 2. In FIG. 1 the retard member is in the form of a retard roll having an outer resilient surface 1 of microcellular elastomer having a hardness of at least about 25 durometer rating. The resilient, frictional microcellular elastomer 1 is mounted upon retarding roll or abutment member 2. The retarding member is mounted by a bolt mounting member designated by the numerals 3 and 4.

Figure 2:
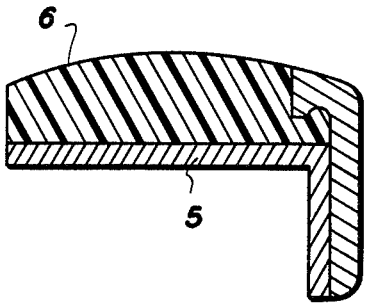
FIG. 2 is a sectional view of a retard pad having a microcellular elastomeric surface.

In FIG. 2 the retard member is shown in the form of a retard pad having a resilient, frictional surface comprising a microcellular elastomer having a hardness of at least about 25 durometer rating designated by numeral 6, mounted upon a rigid surface 5. The operation of the above-illustrated retard members is shown in the above patents incorporated herein by reference. One skilled in the art can provide grooved surfaces on the retard members of the present invention to reduce lead edge delamination.

As described supra, one of the preferred compositions, which has been foamed to form the microcellular elastomer in accordance with the present invention and having a hardness of at least about 25 durometer rating, is polyurethane. However, any microcellular elastomeric material may be used in accordance with the present invention as long as it has the preferred characteristics as set forth supra and including a hardness of at least about 25 durometer rating, a density of about $46.8 \pm 10$ pounds/foot$^3$, a tensile strength of at least about 180 pounds/inch$^2$, a tear strength of at least about 8 pounds/inch, an ultimate elongation of at least about 230 percent, a 25 percent compression deflection at about 50±15 pounds and an average microcellular cell size of about 0.005 inch. As explained supra, variations in cell size which result in an effective durometer hardness rating of at least about 25, may be used in accordance with the present invention. Thus, the average cell size may be greater than or less than about 0.005 inch. Furthermore, the operative compositions of the present invention may also comprise voids or craters or other irregularities spaced randomly therethrough. One skilled in the art of compounding microcellular elastomers can provide such materials having the above-described characteristics without undue experimentation. However, none of the limitations set forth above are to be deemed within the scope of the present invention if they reduce the durometer rating of the microcellular elastomer below about 25.

The initiation or nucleation of cells capable of growth to form the microcellular elastomers having the above-described density, tensile strength, tear strength, cell size and the like can be carried out by one skilled in the art. The factors which merit important consideration in preparing the proper cells in the elastomers in accordance with the present invention include the type and amount of blowing agent, for example, the amount of gas generated, the rate of generation, and the pressure which can be developed to expand the polymer phase; the additives used in the foaming system, for example, cell-control agents used to control the surface tension of the system or to act as nucleating sites from which cells may grow, or added to influence the mechanical stability of the foam structure; and environmental factors such as temperature, geometry of foam expansion, and pressure. The chemical stabilization process is particularly useful in preparing polyurethane foams, and are well known in the art.

Examples of microcellular elastomers which may be used in accordance with the present invention include polyurethanes, poly(vinyl chlorides), copolymers of styrene and acrylonitrile and polyethylene. Other elastomers from which microcellular materials for retard members can be made, include natural rubber, neoprene rubber, styrene/butadiene rubber, nitrile rubber, polychloroprene, chlorosulfonated polyethylene, butyl rubbers and the like.

The thickness of the frictional, resilient material used as the surface of a retard member, may be chosen in accordance with a particular operation of the system for which it is utilized. Furthermore, the retard member may consist entirely of the microcellular elastomer or the microcellular elastomer having a hardness of at least about 25 durometer rating may be a coating upon the surface of a more rigid member. One skilled in the art can choose a suitable thickness and/or member in accordance with the particular system.

A microcellular polyurethane elastomer used as a surface upon a retard roller, wore extremely well, separated ream interface slugs exceptionally well and exhibited very low lead edge delamination in a high speed paper feeder when the elastomeric polyurethane had the following physical characteristics in accordance with the present invention: a density of 46.8±pounds per cubic foot, a 25 percent compression deflection at 50 pounds, a tensile strength of at least 180 pounds/inch$^2$, an ultimate elongation of at least 230 percent, and a tear strength of at least 8 pounds/inch. A retard belt having the above-described composition fed copies with no multifeeds attributable to the retard belt for in excess of 250,000 cycles. The microcellular polyurethane elastomer had a hardness of about 30 durometer rating.

A silicone rubber retard roll of a solid type (non-microcellular) having a hardness of 50 Shore A and a tensile strength of 700 pounds per square inch was only operable for 100,000 cycles. Furthermore, a conventional polyurethane (non-microcellular) having a hardness of 65 Shore A rating and a tensile strength of 4,000 pounds per square inch caused lead edge delamination of the sheets. When the retard roll having a silicone surface was used as described above, the silicone rubber was sheared by the lead edge of the sheet causing excessive wear.

A microcellular polyurethane material used on the surface of a retard pad, and having a hardness of 20 Shore A or less, resulted in multifeed shut down rate increases and was considered ineffective for high speed paper feed applications.

Solid polyurethanes having a hardness of 50 and 60 durometer ratings respectively, were used as surface materials upon retard rolls in accordance with the present invention. The solid polyurethane retard members had long lives, however, they were characterized by a high rate of delamination of the lead edges of sheets.

In accordance with the objects of the present invention there has been described an apparatus and method for separating superposed sheets and feeding said sheets into a xerographic machine by providing a resilient surface having frictional contact with the sheets, the surface comprising a microcellular elastomer having a hardness of at least about 25 durometer rating. The compositions of the present invention produced excellent sheet separation without delamination of the lead edges of the sheets, without consistent or frequent multifeed and without excessive wear of the resilient surface material. Accordingly, there has been provided a retard surface which is soft to permit the lead edge of the sheets to "dig into" the retard means without causing excessive wear of the retard surface and without causing lead edge delamination of the sheets.

While this invention has been disclosed with reference to the compositions disclosed herein for use in retard members, it is not necessarily confined to the details as set forth, and this application is intended to cover such modifications or changes as may come within the scope of the following claims.

What is claimed is:

1. In an apparatus for separating and feeding sheets by means of a sheet separating and feeding device having a retard member the surface of which is a friction member formed of a resilient material, the surface comprising a microcellular elastomer having a hardness of at least 25 durometer.

2. The apparatus of claim 1 wherein the density of the microcellular elastomer is about 46.8±10 pounds/foot$^3$.

3. The apparatus of claim 1 wherein the tensile strength of the microcellular elastomer is at least 180 pounds per square inch.

4. The apparatus of claim 1 wherein the tear strength of the microcellular elastomer is at least 8.0 pounds/inch.

5. The apparatus of claim 1 wherein the ultimate elongation of the microcellular elastomer is at least 230 percent.

6. The apparatus in claim 1 wherein 25 percent compression deflection of the microcellular elastomer occurs at about 50±15 pounds.

7. The apparatus of claim 1 wherein the microcellular cell size of the microcellular elastomer is about 0.005 inch.

8. The apparatus of claim 1 wherein the microcellular elastomer has irregular voids or craters spaced randomly therethrough.

9. The apparatus of claim 1 wherein the microcellular elastomer is a polyurethane which is subjected to a foaming process to reduce the hardness to values above at least 25 durometer.

10. In a method of separating superposed sheets by providing a resilient surface having frictional contact with the sheets, the improvement comprising contacting said superposed sheets with a microcellular elastomer surface having a hardness of at least 25 durometer whereby excellent sheet separation is obtained without delamination of the sheets.

11. The method of claim 10 wherein the density of the microcellular elastomer is about 46.8±10 pounds/foot$^3$.

12. The method of claim 10 wherein the tensile strength of the microcellular elastomer is at least 180 pounds per square inch.

13. The method of claim 10 wherein the tear strength of the microcellular elastomer is at least 8.0 pounds/inch.

14. The method of claim 10 wherein the ultimate elongation of the microcellular elastomer is at least 230 percent.

15. The method of claim 10 wherein 25 percent compression deflection of the microcellular elastomer occurs at about 50±15 pounds.

16. The method of claim 10 wherein the microcellular cell size of the microcellular elastomer is about 0.005 inch.

17. The method of claim 10 wherein the microcellular elastomer has irregular voids or craters spaced randomly therethrough.

18. The method of claim 10 wherein the microcellular elastomer is a polyurethane which is subjected to a foaming process to reduce the hardness to values above at least 25 durometer.

19. A retarding member for separating superposed sheets without delamination of the lead edge of sheets and feeding said sheets into a xerographic machine comprising a surface in frictional contact with the superposed sheets, the surface consisting of a microcellular polyurethane subjected to a foaming process to reduce the hardness thereof to above at least 25 durometer, the microcellular polyurethane foam produced thereby having a density of about 46.8±10 pounds/foot$^3$, a tensile strength of at least 180 pounds/inch$^2$, a tear strength of at least 8.0 pounds/inch, an ultimate elongation of at least 230 percent and 25 percent compression deflection at about 50±15 pounds.

20. The retarding member of claim 19 wherein the microcellular polyurethane has a microcellular cell size of about 0.005 inch and irregular voids or craters spaced randomly therethrough.

* * * * *